US005593311A

United States Patent [19]

Lybrand

[11] Patent Number: 5,593,311

[45] Date of Patent: Jan. 14, 1997

[54] SHIELDED COMPACT DATA CONNECTOR

[75] Inventor: Brent B. Lybrand, Spartanburg, S.C.

[73] Assignee: Thomas & Betts Corporation, Memphis, Tenn.

[21] Appl. No.: 92,049

[22] Filed: Jul. 14, 1993

[51] Int. Cl.[6] ..... H01R 13/28; H01R 13/658

[52] U.S. Cl. ..... 439/295; 439/188; 439/608

[58] Field of Search ..... 439/79, 62, 188, 439/80, 284, 292, 293, 295, 620, 607, 608, 610

[56] References Cited

U.S. PATENT DOCUMENTS

| | | | |
|---|---|---|---|
| Re. 32,760 | 10/1988 | Chandler et al. | 439/188 |
| 4,449,778 | 5/1984 | Lane . | |
| 4,451,107 | 5/1984 | Dola et al. | 339/143 |
| 4,501,459 | 2/1985 | Chandler et al. . | |
| 4,508,415 | 4/1985 | Bunnell . | |
| 4,516,825 | 5/1985 | Brennan et al. . | |
| 4,571,014 | 2/1986 | Robin et al. | 339/14 |
| 4,582,376 | 4/1986 | Olsson . | |
| 4,602,833 | 7/1986 | Grabbe et al. . | |
| 4,619,494 | 10/1986 | Noorily et al. . | |
| 4,641,906 | 2/1987 | Olsson . | |
| 4,653,825 | 3/1987 | Olsson . | |
| 4,659,163 | 4/1987 | Althouse et al. | 439/620 X |
| 4,671,599 | 6/1987 | Olsson | 439/188 |
| 4,682,836 | 7/1987 | Noorily et al. | 439/426 |
| 4,711,507 | 12/1987 | Noorily | 439/292 |
| 4,711,511 | 12/1987 | Noorily | 439/347 |
| 4,731,032 | 3/1988 | Noorily | 439/136 |
| 4,744,769 | 5/1988 | Grabbe et al. | 439/284 |
| 4,756,695 | 6/1988 | Lane et al. | 439/76 |
| 4,824,383 | 4/1989 | Lemke | 439/108 |
| 4,838,811 | 6/1989 | Nakamura et al. | 439/607 |
| 4,846,727 | 7/1989 | Glover et al. | 439/608 |
| 4,859,201 | 8/1989 | Marsh | 439/290 |
| 4,883,433 | 11/1989 | Lane | 439/607 |
| 4,884,981 | 12/1989 | Chandler et al. | 439/610 |
| 4,891,022 | 1/1990 | Chandler et al. | 439/610 |
| 4,898,546 | 2/1990 | Elco et al. | 439/608 |
| 4,983,127 | 1/1991 | Kawai et al. | 439/79 |
| 5,030,114 | 7/1991 | Carey et al. | 439/92 |
| 5,030,121 | 7/1991 | Noorily | 439/188 |
| 5,035,647 | 7/1991 | Schafer | 439/557 |
| 5,052,940 | 10/1991 | Bengal | 439/188 |
| 5,052,948 | 10/1991 | Hyzin | 439/607 |
| 5,066,236 | 11/1991 | Broeksteeg | 439/79 |
| 5,074,803 | 12/1991 | Chandler et al. | 439/347 |
| 5,088,934 | 2/1992 | Chow et al. | 439/395 |
| 5,098,311 | 3/1992 | Roath et al. | 439/79 X |
| 5,104,337 | 4/1992 | Chow et al. | 439/470 |
| 5,112,243 | 5/1992 | Chow et al. | 439/352 |
| 5,122,076 | 6/1992 | Pitts | 439/352 |
| 5,160,273 | 11/1992 | Carney | 439/108 |
| 5,169,346 | 12/1992 | Johnston | 439/676 |
| 5,178,554 | 1/1993 | Siemon et al. | 439/188 |
| 5,190,464 | 3/1993 | Chow et al. | 439/188 |
| 5,190,479 | 3/1993 | Jordi | 439/620 |
| 5,228,871 | 6/1993 | Goodman | 439/607 |
| 5,328,380 | 7/1994 | Carney | 439/188 |
| 5,376,021 | 12/1994 | Rodrigues et al. | 439/608 |
| 5,405,268 | 4/1995 | Gazzara et al. | 439/188 |
| 5,487,682 | 1/1996 | Miller et al. | 439/607 |

*Primary Examiner*—Neil Abrams

*Attorney, Agent, or Firm*—Michael L. Hoelter; Salvatore J. Abbruzzese

[57] ABSTRACT

An electrical connector component assembly (10) provides for shielding as between components of the connector. An electrically conductive outer housing (12) includes a plurality of discrete bounded compartments (30). A plurality of electrically insulative terminal support elements (14, 16) are supported individually in the bounded compartments. Plural electrical contacts are supported in at least one of the support elements. The electrical contacts supported in the one support element are electrically shielded from the components of the other support element by the bounded compartments. The electrical connector component assembly (10) may be interconnected to an identical connector in hermaphroditic fashion such that mating contact surfaces (74) engage one another locking the contact to the like contact.

27 Claims, 9 Drawing Sheets

SHIELDED COMPACT DATA CONNECTOR

FIELD OF THE INVENTION

The present invention relates generally to improvements in shielded electrical data connectors. More particularly, the present invention relates to a compact design for a shielded electrical data connector wherein electrical contacts of the connector are electrically shielded from other components of the connector.

BACKGROUND OF THE INVENTION

Improvements in the electrical data transmission industry, especially in the computer field, have resulted in the ability to transmit data along transmission lines at increasingly higher data rates. Further, similar improvements have also seen the decrease in the size of the equipment used in the industry. In order to function effectively with such equipment, the interconnection technology, such as the electrical cables and electrical connectors which connect such equipment, has also undergone significant improvements. Electrical connectors are now smaller and capable of transmitting data at higher rates between such components.

The requirement to make the electrical connectors smaller necessitates putting the conductive contacts of such connectors in closer proximity. However, when transmitting data at higher data rates, this physical proximity also increases the cross-talk levels between such electrical contacts. Accordingly, the industry has seen the need for improved shielding within the electrical connectors so as to reduce cross-talk levels in the smaller connectors working at higher data rates. This is especially prevalent in connectors used in closed-loop data systems which provide for continuity of signal in a multi-component system when certain of the connectors are not interconnected. These closed-loop systems employ connectors containing devices which permit automatic shunting so that a closed-loop connection is maintained even when a connector is in a non-connected condition. Such shunting devices in these connectors render effective shielding even more difficult.

It is, therefore, desirable to provide an electrical connector which provides for shielding in a compact connector design and which reduces cross-talk between contacts of the connector when operating at higher data rates.

SUMMARY OF THE INVENTION

It is an object of the present invention to provide an improved shielded electrical data connector.

It is a further object of the present invention to provide a data connector of compact size which is operable at higher data rates.

It is a still further object of the present invention to provide a data connector having improved shielding which reduces cross-talk between contacts of the connector.

In the efficient attainment of these and other objects, the present invention provides an electrical connector which includes an electrically conductive outer housing having a plurality of discrete bounded compartments therein. Accommodated in the outer housing are a plurality of electrically insulative terminal support elements. Each support element is accommodated in one of the bounded compartments of the outer housing. Plural electrical contacts are supported in at least one of the terminal support elements. The bounded compartments of the outer housing serve to electrically shield the contacts of the one terminal support element from components supported in the other of the terminal support elements.

As more particularly described by way of the preferred embodiment herein, one electrically insulative terminal support element supports plural electrical contacts therein which provide for transmission of electrical signals therethrough. At least one other terminal support element may support either similar electrical contacts or signal transmission terminals of different function, for example fiber optic terminals. In either case, the electrical contacts of the one terminal support element would be electrically shielded from the components of the other terminal support element.

DETAILED DESCRIPTION OF THE PREFERRED EMBODIMENTS

Figure 1:
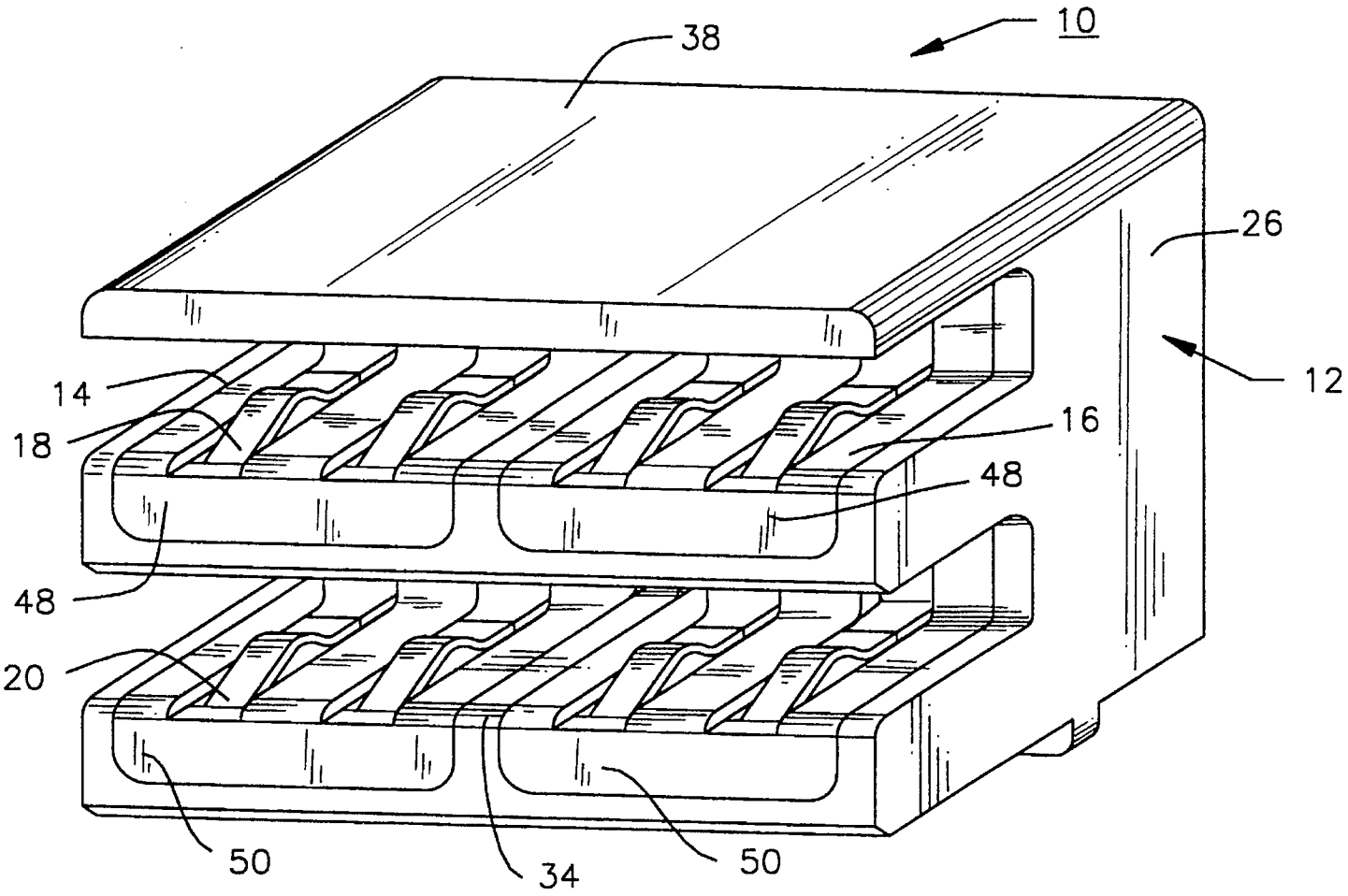
FIG. 1 is a front perspective showing of the compact shielded data connector assembly of the present invention.
Figure 2:
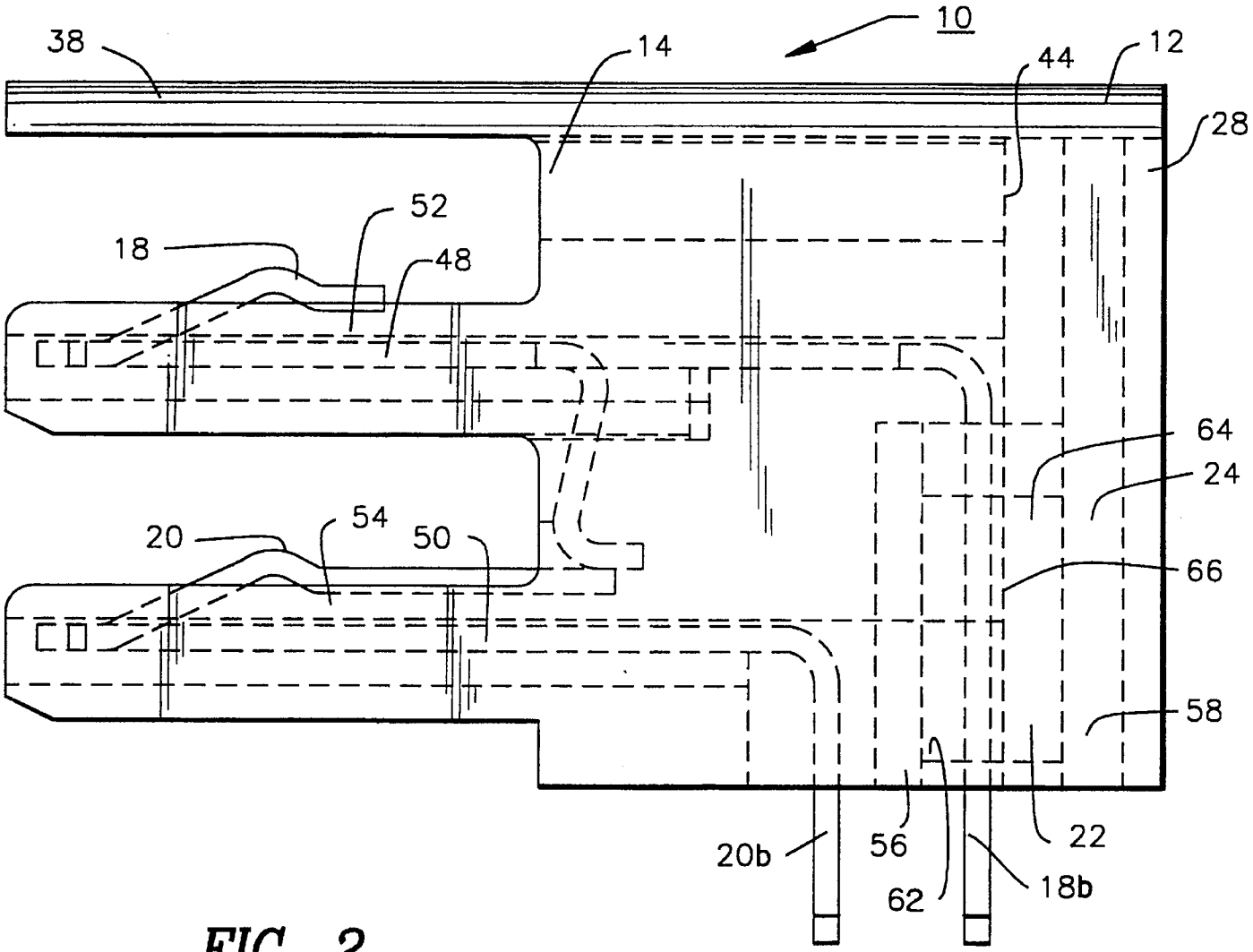
FIG. 2 is a side-plan view of the connector assembly of FIG. 1.
Figure 3:
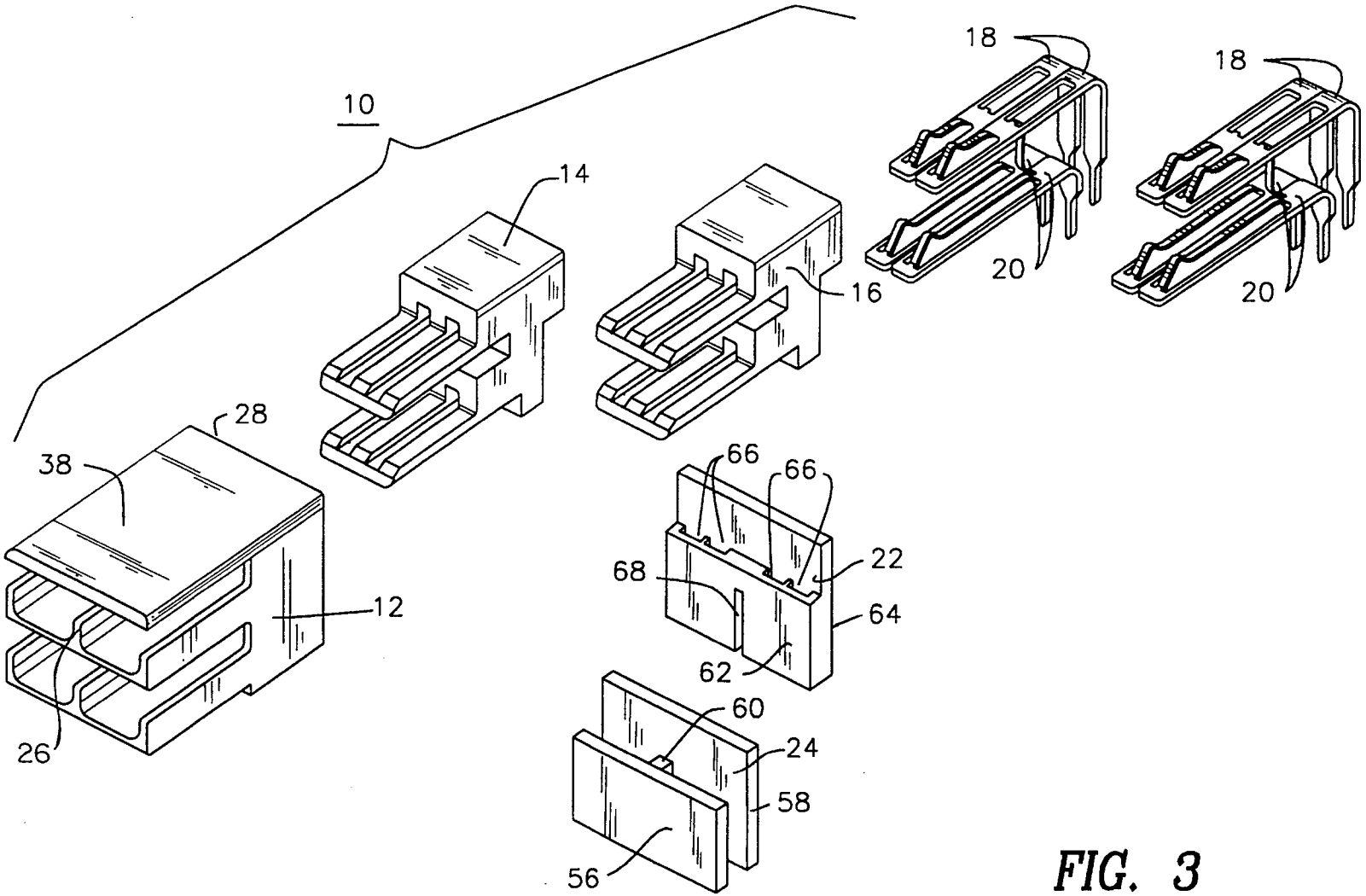
FIG. 3 shows, in exploded perspective view, components of the connector assembly of FIGS. 1 and 2.

Referring to FIGS. 1–3, a shielded compact electrical data connector assembly 10 of the present invention is shown. Data connector assembly 10 is of the type used to transmit data signals between components of a closed-loop data system. Connector assembly 10 may function in hermaphroditic fashion, that is, it is interconnectable to a similarly formed electrical connector assembly, or it may function in a panel mount environment where plural such connector assemblies are supported on a wiring panel for connection with similarly formed electrical connectors.

The connector assembly 10 of the present invention may be of the type shown and described in U.S. patent application Ser. No. 08/013,452, filed Feb. 4, 1993 entitled VERTICALLY ALIGNED ELECTRICAL CONNECTOR COMPONENTS, now U.S. Pat. No. 5,405,268, which is assigned to the assignee of the present invention and which is incorporated by reference herein for all purposes.

Connector assembly 10 comprises an electrically conductive outer housing 12, a pair of side by side electrically insulative support members 14 and 16, upper and lower electrical contacts 18 and 20, respectively, an insulative rear-contact support 22 and a rear-conductive shield 24.

Conductive outer housing 12 and conductive rear shield 24 are formed in the preferred embodiment of die-cast metal. However, other conductive elements such as conductive plastic or metalized plastic may be employed. Support members 14 and 16, as well as contact support 22, are formed of a suitably electrically insulative plastic. Electrical contacts 18 and 20 are formed of a suitably conductive metallic material such as beryllium copper.

Figure 5:
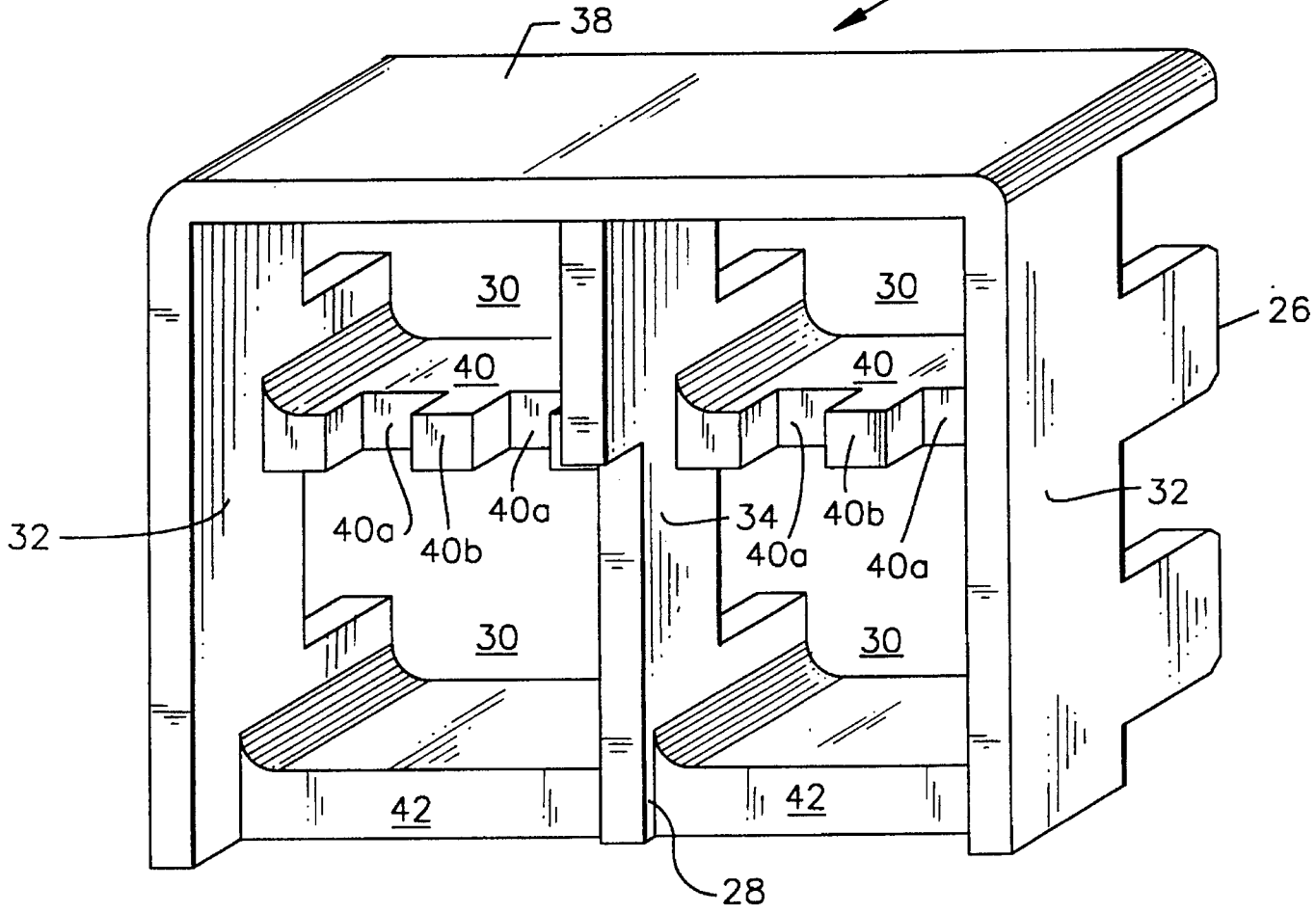
FIG. 5 is a rear-perspective view of the outer housing of the connector assembly of FIG. 1.

Referring additionally to FIG. 5, outer conductive housing 12 is shown in further detail. Outer housing 12 is generally an elongate rectangular member having a front interconnection end 26 and a rear contact accommodating end 28. Outer housing 12 is divided into four discrete compartments 30 arranged in side by side and upper and lower quadrants. Outer housing 12 includes a pair of opposed spaced-apart vertical side walls 32 and a central vertical dividing wall 34. A horizontal upper wall 38 extends across the upper extents of side walls 32 and dividing wall 34.

Outer housing 12 further includes intermediate horizontal bridge portions 40 extending between side walls 32 and dividing wall 34, as well as lower horizontal bridge portions 42, which also extend between side walls 32 and dividing wall 34. The construction of outer housing 12 provides for the complete perimetrical bounding of compartments 30. It is contemplated that in the preferred embodiment, the outer housing 12 will be integrally formed. However, individual components may be used to make up outer housing 12.

Figure 6:
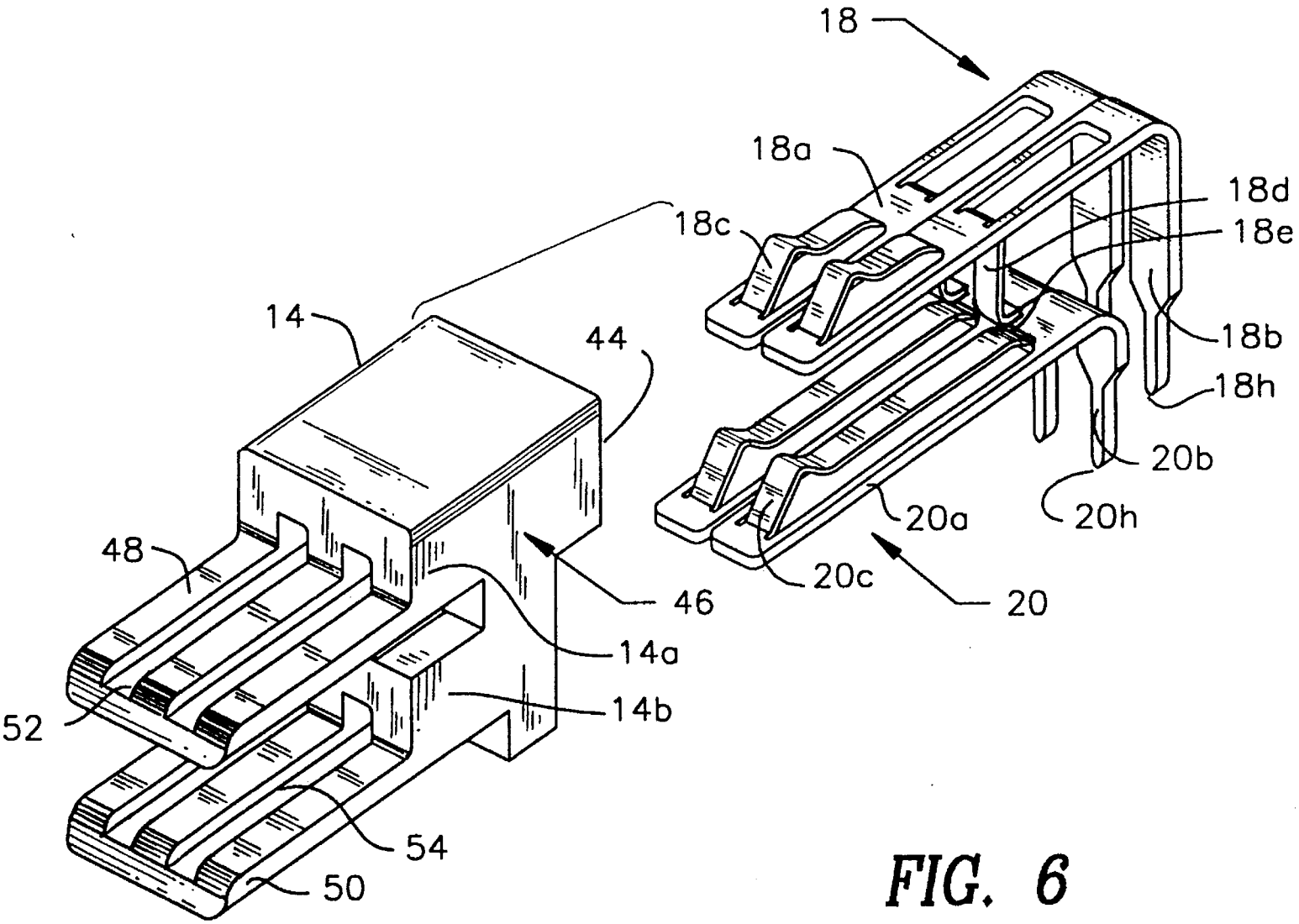
FIGS. 6 and 7 are, respectively, exploded front and rear perspective views of the insulative support member and electrical contacts of the connector assembly of FIG. 1.
Figure 7:
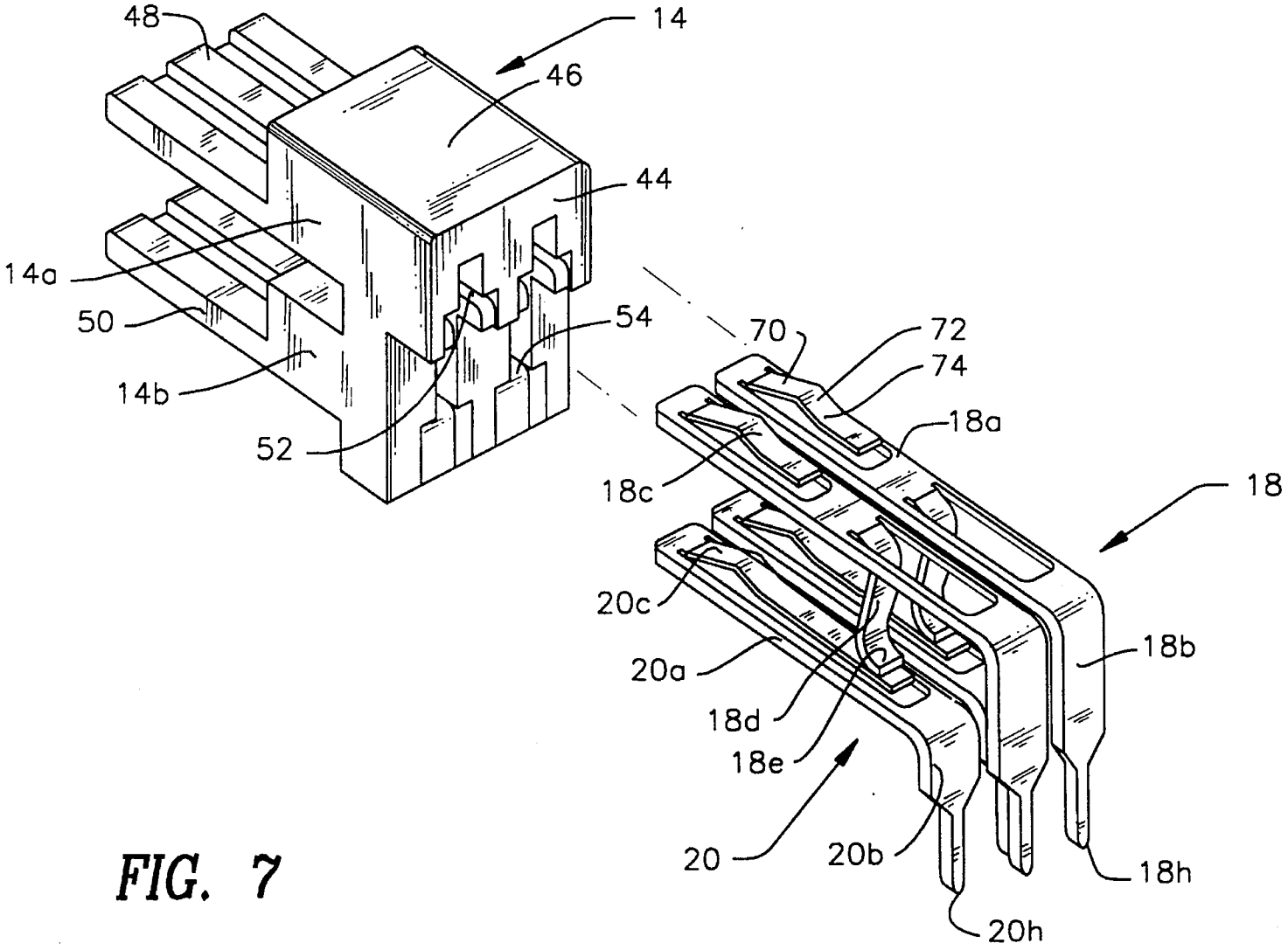

Referring now to FIGS. 6 and 7, terminal support members 14 and 16, as well as upper and lower contacts 18 and 20, are shown in more detail. Support members 14 and 16 are preferably of identical construction. For clarity of explanation, FIGS. 6 and 7 show only support member 14. Support member 14 is generally an elongate molded plastic member having a rear contact accommodating end 44, a central main body portion 46 and upper and lower support platforms 48 and 50 extending oppositely from rear contact accommodating end 44. Support member 14 includes a pair of side by side upper channels 52 extending from rear contact accommodating end 44 through central main body portion 46 and along upper support platform 48. Similarly, side by side lower channels 54 extend from the rear contact accommodating end 44 through central main body portion 46 and along lower support platform 50. Each support member 14 is divided into individual upper and lower stacked support elements **14*a* and 14*b* which include upper and lower support platforms 48 and 50, respectively. While support member 14** is shown to be integral, it is contemplated that the support member may comprise separate upper and lower support elements.

FIGS. 6 and 7 further show upper and lower electrical contacts 18 and 20 which are typically stamped and formed members. Lower contacts 20 include a generally elongate base portion **20*a*, a pin-type solder tail 20*b* and a reversely directed cantilevered spring portion 20*c* which extends back over base portion 20*a*. Solder tail 20*b* is of conventional construction and may be inserted into a through hole of a printed circuit board (not shown) and soldered thereto establishing electrical connection therebetween. In the present illustrative embodiment, solder tail 20*b* is shown extending downwardly at a right angle from base portion 20*a*, however, straight-solder tails may also be employed. Cantilevered spring portion 20*c* is constructed so as to be deflectable for movement toward and away from base portion 20*a* upon interconnection of a further connection device. Cantilevered spring portion 20*c* has an extended beam length which extends toward solder tail 20*b***.

Upper contacts 18 are of construction similar to that of contacts 20. Contacts 18 include an elongate base portion **18*a*, a solder tail 18*b* and a reversely directed cantilevered spring portion 18*c* of length shorter than cantilevered spring portion 20*c* of contact 20. As contacts 18 and 20 are arranged in upper and lower fashion, solder tail 18*b* of contacts 18 are longer than the solder tails 20*b* of contacts 20 so that the distal extents 18*h* and 20*h*** of the solder tails extend approximately the same distance, facilitating connection of the solder tails to a printed circuit board.

As shown in FIGS. 6 and 7, upper contacts 18 include a depending shunt member **18*d* which is struck from a central extent of planar base portion 18*a*. The distal extent 18*e* of shunt member 18*d* is engagable with the extended beam of cantilevered spring portion 20*c* of contacts 20 to provide for shunted engagement as between contacts 18 and 20. The description of the shunting between contacts 18 and 20 is described in further detail in the above-identified incorporated reference. Shunt member 18*d* of contact 18 extends downwardly from base portion 18*a* at an angle just less than 90°. Also, the distal extent 18*e* has a reversely curved portion. Upon shunting engagement of shunt member 18*d* with cantilevered spring portion 20*c***, a wiping engagement is achieved.

As shown in further detail in FIG. 2, contacts 18 and 20 are supported within support member 14. Base portions **18*a* and 20*a* are supported respectively on platforms 48 and 50 through upper and lower channels 52 and 54. Solder tails 18*b* and 20*b* extend along rear contact accommodating end 44 of support member 14**.

Support members 14 and 16 supporting upper and lower contacts 18 and 20 are inserted into outer housing 12 in side by side fashion. Each upper and lower support platform 48 and 50 of support members 14 and 16 are individually accommodated in one of the bounded compartments 30 of outer housing 12 (FIG. 5). Upper wall 38, side walls 32 and lower bridge portions 42 serve to shield collectively the contact 18 and 20. Dividing wall 34 serves to shield each of the side by side pairs of contacts 18 and 20. Intermediate bridge portions 40 serve to shield the upper contacts 18 from the lower contacts 20. Thus, each pair of contacts supported by each of the platforms, will be electrically shielded from the contact pairs of the other platforms by its residence in an individual bounded compartment 30. Further, intermediate bridge portion 40 includes spaced recesses **40*a* separated by a central protrusion 40*b*. Shunt member 18*d* of each contact 18 extends through recess 40*a*. The central protrusion 40*b* provides shielding as between adjacent shunt member 18*d***.

Referring again to FIGS. 2 and 3, the shielding of contacts 18 and 20 is continued at the contact accommodating end 28 of housing 12 by rear shield 24. Shield 24, formed of conductive metal, includes a short forward wall 56 and a taller rear wall 58 separated by a centrally located transverse web 60. Shield 24 provides conductive shielding as between solder tails **18*b* of upper contacts 18 and solder tails 20*b* of lower contacts 20. This is achieved by positioning solder tail 20*b* on one side of forward wall 56 while solder tails 18*b* are positioned on the other side of forward wall 56. Solder tails 18*b* reside between walls 56 and 58**.

In order to support solder tails **18*b* of contacts 18, connector assembly 10 includes insulative contact support 22. Contact support 22 is a plastic member having a front wall 62, a taller rear wall 64 and individual chambers 66, which individually accommodate solder tails 18*b* of contacts 18. Contact support 22 includes a recess 68 extending from a lower edge thereof which accommodates web 60 of shield 24 when contact support 22 is inserted within shield 24**.

In operation, once the support members 14 and 16 supporting contacts 18 and 20 are inserted into outer housing 12, shield 24, having contact support 22 inserted therein, may be inserted over the solder tails **18*b* of contacts 18 to reside adjacent contact accommodating end 28 of outer housing 12**.

Figure 4:
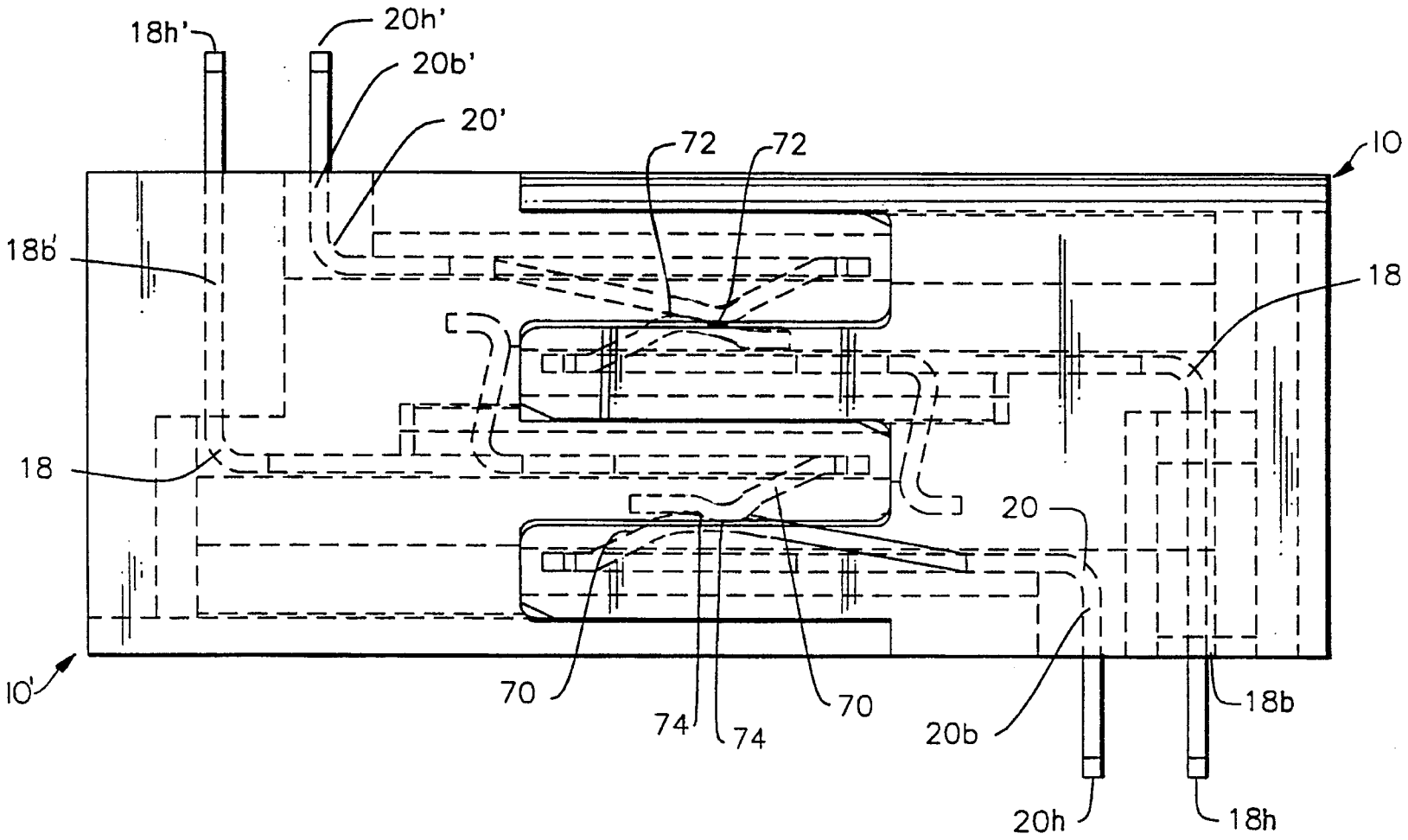
FIG. 4 shows an electrical connector of FIG. 1 interconnected with a like connector in hermaphroditic fashion.

Referring to FIG. 4, connector assembly 10 is shown interconnected to an identical connector 10' in hermaphroditic fashion. This is accomplished by rotating connector assembly 10' 180° and interconnecting the two parts so that upper contacts 18 of connector assembly 10 engage lower contacts 20' of connector assembly 10', while lower contacts 20 of connector assembly 10 engage upper contacts 18' of connector assembly 10'. It is noted that as the lower contacts of one connector engage the upper contacts of the other connector when connected in hermaphroditic fashion, the electrical path between each pair of the mated contacts will be the same for all contact pairs. Thus the electrical path length between the tip **18*h*' of solder tail 18*b*' and the tip 20*h* of solder tail 20*b*, which is connected thereto, is the same as the path length between the tip 18*h* of solder tail 18*b* and the tip 20*h*' of solder tail 20*b*'** of another connected pair of contacts. By creating identical electrical path lengths, impedance mismatch is reduced as between mated pairs of contacts.

Referring to FIGS. 4 and 7, another feature of the present invention may be described. Cantilevered spring portions **18*c* and 20*c* of upper and lower contacts 18 and 20 further provide a first upwardly inclined contact surface 70 extending from the front end of the contacts to a centrally located apex 72. The contact further includes a depending rearwardly facing engagement surface 74 extending from apex 72 down to the distal end of the contacts. As hermaphroditic connection is made as shown in FIG. 4, the first contact surfaces of the mating contacts will ride against each other until the apices of the respective contacts bypass one another. The inherent spring bias of cantilevered spring portion 18*c* and 20*c* permit such engagement. Once the apices are bypassed, the depending engagement surfaces 74 will engage in locking fashion. Thus the mechanical engagement of the mated contacts of the hermaphroditic connectors will serve, to some degree, to lock the contacts together thereby locking the respective connectors together. This locking feature also assures proper connection of connector assembly 10 to connector assembly 10'**.

Figure 8:
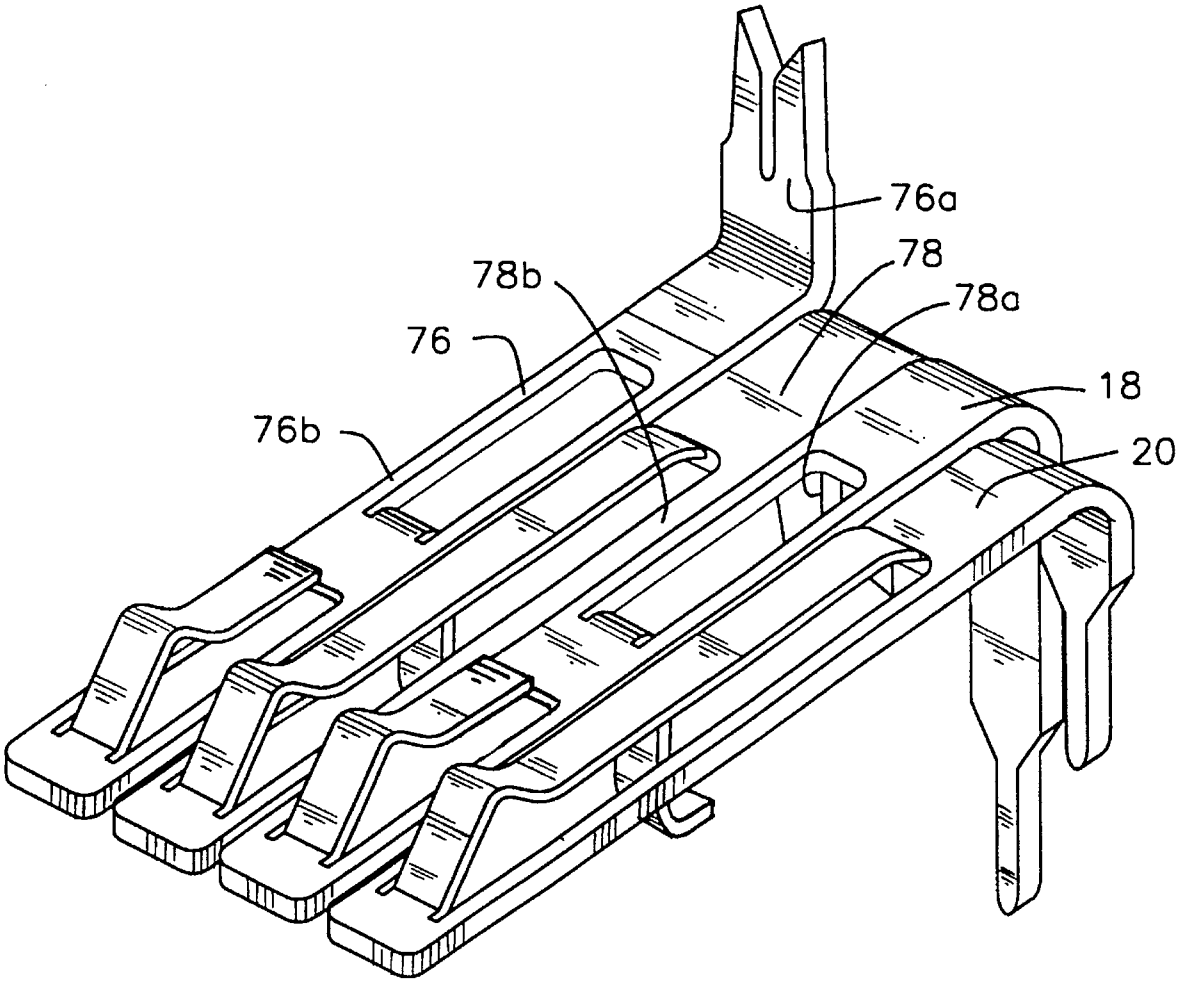
FIG. 8 is a perspective showing of alternative constructions of the electrical contacts of the connector assembly of FIG. 1.
Figure 9:
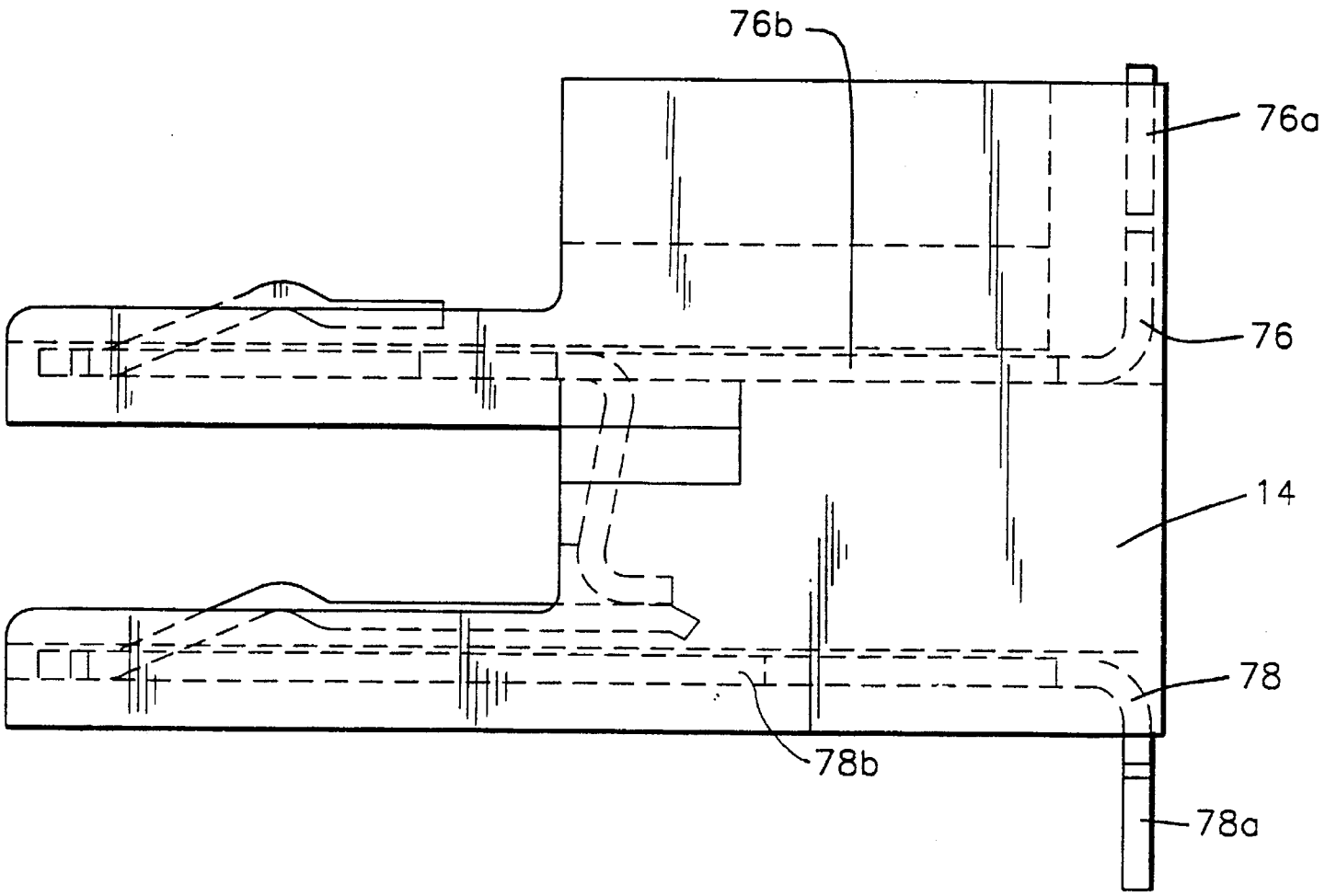
FIG. 9 is a side-plan view of the alternative contacts of FIG. 8 supported within the terminal support member.

Further embodiments of the present invention may be shown in FIGS. 8 an 9. Contacts of the present invention include solder type tails **18*b* and 20*b* such as shown in contacts 18 and 20 for attachment to through holes of a printed circuit board. However, the present invention also contemplates employing other contact types 76 and 78, which include IDC portions 76*a* and 78*a* for making insulation displacing connection to electrical conductors (not shown) in a manner described in the above-incorporated patent application. IDC portions 76*a* and 78*a* may extend at oppositely directed 90° angles from the central base portions 76*b* and 78*b* of contacts 76 and 78. FIG. 9 shows such insulation displacement contacts 76 and 78 supported in a support member 14**.

Additionally, since support members 14 and 16 may be inserted into outer housing 12 in a modular fashion, connector assembly 10 of the present invention may accommodate different transmission styles within the same connector assembly. While the present embodiment shows transmission terminal devices of the electrical signal type, other terminals, such as fiber optic terminations and power contacts, may be inserted into connector assembly 10. It is further contemplated that the transmission terminal device may be the stamped end of a co-axial cable where the center conductor serves as an electrical contact. Support members 14 and 16 can be adapted to accommodate such co-axial cable. Thus, connector assembly 10 may house mixed transmission components.

Various changes to the foregoing described and shown structures would now be evident to those skilled in the art. Accordingly, the particularly disclosed scope of the invention is set forth in the following claims.

I claim:

1. An electrical connector comprising:

an electrically conductive outer housing having a plurality of discrete bounded compartments;

electrically insulative terminal support elements, each said support element being accommodated in one of said bounded compartments, a pair of said electrically insulative terminal support elements being formed integrally in stacked relation, said stacked terminal support elements having portions resident in a pair of vertically aligned said bounded compartments of said outer housing; and plural transmission terminal devices supported in at least one said support element;

said terminal devices of said one support element being electrically shielded from the other said support elements by said bounded compartment.

2. An electrical connector of claim 1 wherein said transmission terminal devices of one said support elements are electrical contacts.

3. An electrical connector of claim 2 wherein at least another said support element supports additional electrical contacts.

4. An electrical connector of claim 2 wherein each said electrical contact includes an interconnection end for electrical engagement with a contact of a mating connector and a terminal end opposite said interconnection end.

5. An electrical connector of claim 4 wherein said terminal end includes a pin-type solder tail.

6. An electrical connector of claim 4 wherein said terminal end includes an insulation displacement contact portion.

7. An electrical connector of claim 1 wherein said outer housing is formed from die cast metal.

8. An electrical connector of claim 1 wherein said connector is hermaphroditic.

9. An hermaphroditic electrical connector comprising:

a connector housing configured for mating engagement with a like housing; and at least one electrical contact supported in said housing and configured for mating electrical engagement with a like contact;

said electrical contact having a mating end and an opposed termination end;

said mating end of said contact having an elongate deflectable contact beam including a central apex, an inclined front facing mating surface on one side of said apex and an inclined rear facing engagement surface on the other side of said beam;

wherein upon said hermaphroditic interconnection of said electrical contact with said like contact said front facing mating surfaces make initial engagement, said apices pass over one another deflecting said contact beams and said rear facing engagement surfaces contact one another locking said contact to said like contact.

10. An hermaphroditic electrical connector of claim 9 wherein said contact further includes a contact base, said deflectable contact beam extending over said base.

11. An hermaphroditic electrical connector of claim 10 wherein said contact further includes said termination end including a contact tail extending from said contact base.

12. An hermaphroditic electrical connector of claim 11 wherein said connector housing supports plural said electrical contacts.

13. An electrical connector comprising:

a connector housing configured for mating engagement with a complementary housing; and at least two pair of electrical contacts supported in said housing in stacked relationship and configured for mating electrical engagement with at least two pair of complementary contacts;

each said electrical contact having a mating end and an opposed termination end;

each said mating end of said contacts having an elongate deflectable contact beam including a central apex, an inclined front facing mating surface on one side of said apex and an inclined rear facing engagement surface on the other side of said beam;

wherein upon interconnection of said electrical contacts with said complementary contacts said front facing mating surfaces make initial engagement, said apices pass over one another deflecting said contact beams and said rear facing engagement surfaces contact one another.

14. An electrical connector of claim 13 wherein said elongate deflectable contact beams are all deflectable in the same direction.

15. A shielded electrical connector for mounting on a printed circuit board comprising:

an outer conductive shield including opposed upper and lower walls, and opposed side walls defining a mating end and a terminating end, the outer shield including a rear shield extent disposed at the terminating end of said outer shield, said rear shield extent being separate from said outer shield side walls and upper lower walls;

a horizontal shield extent extending between opposed side walls;

a vertical shield extent extending between opposed upper and lower walls, said horizontal and vertical shield extents together with said upper and lower walls and said side walls defining four individually shielded quadrants;

an insulative member in each quadrant;

a pair of electrically conductive contacts in each quadrant, each contact having a mating portion within said shield and accessible in a respective quadrant for connection to a contact of a complementary connector, each contact having a terminating portion projecting outwardly from said outer shield for connection to a conductive element on a printed circuit board, the terminating portions of contacts in the upper quadrants lying in a first row and the terminating portions of contacts in the lower quadrants lying in a second row spaced from said first row, and wherein the rear shield extend includes a first wall portion disposed between said first row and said second row.

16. A shielded electrical connector according to claim 15 wherein said pairs of contacts in said lower quadrants are aligned with said pairs of contacts in said upper quadrants.

17. A shielded electrical connector according to claim 16 wherein said mating portions of said contacts are deflectable.

18. A shielded electrical connector according to claim 17 wherein said mating portions of said contacts are all deflectable in the same common direction.

19. A shielded electrical connector according to claim 16 wherein said vertical shield extent electrically and mechanically connects said upper and lower walls.

20. A shielded electrical connector according to claim 19 wherein said horizontal shield extent electrically and mechanically connects said side walls.

21. A shielded electrical connector according to claim 20 wherein said upper and lower walls, said side walls, said vertical shield extent and said horizontal shield extent are integrally formed as a unitary piece.

22. A shielded electrical connector according to claim 16 wherein said terminating portions of said contacts are formed at substantially right angles to said mating portions.

23. A shielded electrical connector according to claim 15 wherein said rear shield extent includes a second wall portion disposed externally of said first and second rows and spaced from said first wall portion.

24. A shielded electrical connector according to claim 23 wherein said first and second wall portions are joined by a conductive web.

25. A shielded electrical connector according to claim 24 wherein said web lies transversely between two pair of contacts in at least one of said rows.

26. A shielded electrical connector according to claim 15 further including an insulative support for said contact terminating portions having a portion lying between said first and second rear shield extent wall portions.

27. A shielded electrical connector according to claim 26 wherein said insulative support is separate from each said insulative member.

* * * * *